United States Patent [19]

Roche et al.

[11] 4,212,598

[45] Jul. 15, 1980

[54] TRAFFIC-OPERATED AIR-POWERED GENERATING SYSTEM

[75] Inventors: Dwain F. Roche, Manhattan; Stanley E. Banks, New Strawn, both of Kans.

[73] Assignee: Energy Development Corporation, New Strawn, Kans.

[21] Appl. No.: 926,334

[22] Filed: Jul. 20, 1978

[51] Int. Cl.[2] ..... F04B 35/00; F04B 43/05

[52] U.S. Cl. ..... 417/229; 417/478

[58] Field of Search ..... 417/225, 229, 231, 234, 417/478

[56] References Cited

U.S. PATENT DOCUMENTS

| | | | |
|---|---|---|---|
| 1,771,200 | 7/1930 | Akers | 417/229 |
| 2,020,361 | 11/1935 | Johnston | 417/229 X |
| 2,333,614 | 11/1943 | Boyd | 417/229 |
| 2,977,040 | 3/1961 | Dulebohn et al. | 417/225 |
| 3,088,417 | 5/1963 | Johnston | 417/229 |
| 3,679,331 | 7/1972 | Kushner | 417/478 X |
| 3,688,859 | 9/1972 | Hudspeth et al. | 417/233 X |
| 3,918,844 | 11/1975 | Bailey | 417/229 |
| 4,012,177 | 3/1977 | Yakich | 417/475 X |
| 4,081,224 | 3/1978 | Krupp | 417/229 |
| 4,115,034 | 9/1978 | Smith | 412/231 |

FOREIGN PATENT DOCUMENTS 1944102 10/1970 Fed. Rep. of Germany ..... 417/474

*Primary Examiner*—Richard E. Gluck

*Attorney, Agent, or Firm*—Schmidt, Johnson, Hovey & Williams

[57] ABSTRACT

A series of intermittently operable air pumps taking the form, for example, of transversely collapsible tubes or piston and cylinder assemblies, are located in recesses of a surface along which recurrent traffic moves, e.g., a factory floor subject to foot traffic and vehicular traffic, a highway, a sidewalk, or a surface along which a conveyor travels. Depressible actuating panels or treadles are operated by the traffic to in turn squeeze the tubes or move the pistons through pumping strokes, the tubes or pistons returning to their normal positions at the conclusion of such pumping strokes via yieldable means or otherwise. During such return action, the pumps operate through suction strokes such as to draw in a new supply of fluid, e.g. the ambient air, in readiness for the next operation of the actuating treadle by the traffic. Suitable check valves are employed to prevent retrograde movement of the fluid and special booster apparatus may be employed if necessary to ultimately achieve the desired energy output necessary to drive the selected equipment.

9 Claims, 4 Drawing Figures

TRAFFIC-OPERATED AIR-POWERED GENERATING SYSTEM

TECHNICAL FIELD

This invention relates to the utilization of otherwise wasted energy to perform usable work and therefore pertains to energy conservation systems.

BACKGROUND ART

The movement of pedestrians along sidewalks, cars along streets, industrial vehicles along factory floors and even certain conveying mechanism and the like along prescribed paths of travel represents an immense yet heretofore untapped source of energy to provide electricity or to perform other work functions. Every step of the pedestrian and every revolution of the wheel of a vehicle results in a powerful thrust of force, generally directed toward the ground, which has heretofore been wasted, to the detriment of our nation's energy resources.

SUMMARY OF THE INVENTION

Accordingly, it is an object of the present invention to utilize such heretofore wasted energy and to convert the same into usable form. In this regard, we contemplate installing special fluid pumps, preferably of the ambient air type, at locations which predictably receive substantial traffic, e.g., foot traffic, vehicular traffic or otherwise, and arranging such pumps so that they are operated by the traffic passing over the pumps. Each time one of the pumps is operated by one unit of traffic, the pump is operable to send a slug of pressurized fluid toward a common holding tank for several of the pumps or directly to equipment which utilizes the outlet from the pumps and performs a work function. As soon as the particular unit of traffic passes over the pump, the pump completes a suction stroke to draw in a new supply of fluid in readiness for the next pumping stroke. Properly positioned check valves are utilized to assure that no retrograde flow of the fluid can take place.

Although the pumps and actuators therefore may take several different forms, we have selected two of such forms for illustration herein, i.e., a collapsible pump tube as one type and a cylinder assembly as the second type. In each instance, the pump is received within a recess in the traffic-exposed surface with only a portion of the pump projecting above the recess. The actuator takes the form of a treadle or other suitable device which can be disposed in force transmitting relationship to the pump and yet will not interfere with free flow of the traffic along the surface. Most ideally, each of the treadles is hingedly connected to the surface and is disposed in an upwardly inclined direction in the normal path of travel of the traffic, the treadle having only a short arcuate displacement about its hinge upon actuation by the traffic flow.

Also, ideally, the treadle does not bear directly upon the pump when the latter is a tube, but rather indirectly exerts its operating force via a flexible bearing member of suitable synthetic resinous material so as to avoid undue wear on the resilient tube itself.

Booster apparatus may be utilized if desired and necessary to increase the power available from the individual pumps, such booster apparatus including, for example, a rotary fluid motor whose discharge outlet is in turn connected to a rectilinear fluid motor which leads into a holding tank having a reduction valve at its outlet end.

DETAILED DESCRIPTION

Figures 2, 3, 4:
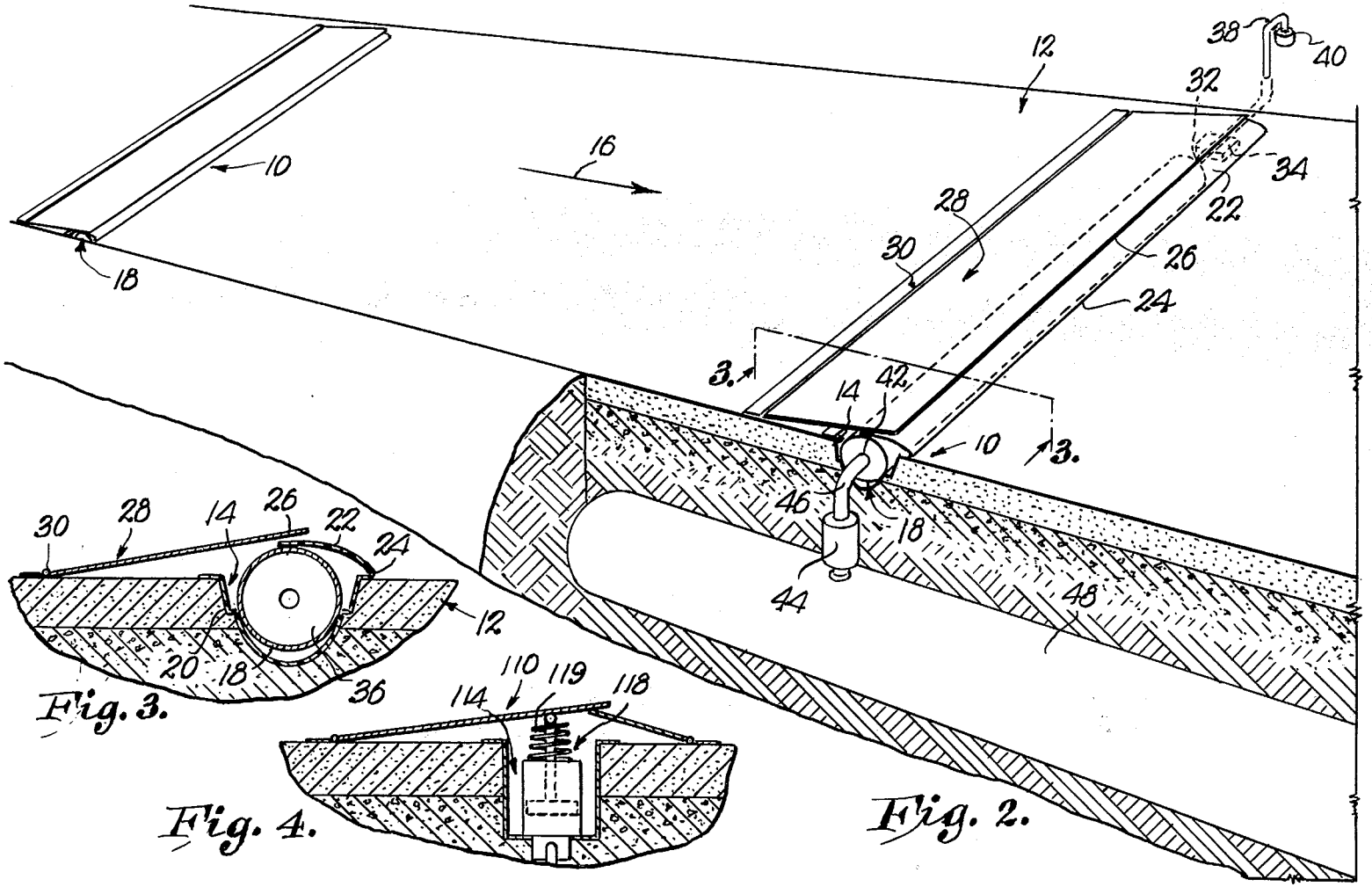
FIG. 2 is a partially broken away front perspective view of a portion of the system revealing details of construction of one form of pump pursuant to the present invention.
FIG. 3 is a fragmentary, slightly enlarged cross sectional view of the pump of FIG. 2 taken substantially along line 3—3 thereof.
FIG. 4 is a fragmentary cross sectional view similar to FIG. 3 but showing a second type of pump.

FIG. 2 shows a pump 10 associated with a surface 12 which may, of course, take any number of different forms. In the illustrated embodiment, the surface 12 comprises part of a street or highway having the usual road bed and constructed in the usual manner with the exception of providing a longitudinal recess 14 disposed transversely of the normal direction of traffic flow as indicated by the arrow 16. The pump 10 chosen for purposes of illustration in FIG. 2 is a device in the form of a resilient tube 18. It is to be pointed out that other types of resilient devices having variable volume pumping chambers associated therewith may be utilized instead of the tube 18 (such as, for example, a suitable diaphragm pump), but for purposes of explaining the principles of the present invention as it relates to pumps utilizing resilient members, the tube 18 will suffice.

The recess 14 is provided with a liner 20 conforming to the somewhat irregular shape of the recess 14 and extending along the full length of the latter. The liner 20 thus serves to facilitate runoff of any moisture that might otherwise collect within the recess 14, and in this connection it is preferable that the recess 14 be inclined sufficiently such as to promote such drainage. Integrally connected to the liner 20 at one upper extremity thereof is a flap-like bearing member 22 having a hinged line of interconnection 24 with the remainder of the liner 20 so that the member 22 can swing toward any away from the recess 14. As illustrated in FIG. 3 and as also shown to some extent in FIG. 2, the member 22 overlies the tube 18 to a certain extent and normally is in physical engagement with the latter.

As shown in FIG. 3, the tube 18 projects partially out of the recess 14 and thus supports the free outer end 26 of an actuating treadle 28 in the form of a solid panel, the treadle 28 being hingedly connected at 30 to the surface 12 for swinging movement toward and away from the recess 14. The treadle 28 is therefore in position to receive operating impulses from the traffic along the surface 12 and, because of the face that the lower end of the treadle 28 is indeed substantially flush with the surface 12, there is no interference on the part of the treadle 28 with traffic flow. As illustrated in FIG. 3, the treadle 28 is disposed to transmit operating force to the bearing 22 which in turn transmits operating force to the tube 18, this interpositioning of the bearing member 22 serving to preserve the useful life of the tube 18 which may conveniently be constructed of a rubber or synthetic resinous material that might be unduely abraded by the treadle 28 which would normally be fabricated from a strong metal. The bearing member 28, as well as its associated liner 20, is preferably of a suitable synthetic resinous material providing long life and yet a certain degree of resiliency.

The tube 18 has an inlet 32 at one end thereof provided with a check value 34 which permits fluid flow into the chamber 36 of tube 18 (FIG. 3) during a suction stoke of the latter but prohibits fluid flow out of the inlet 32 during a positive pressure pumping stroke. Preferably, the pumping tube 18 is disposed to pump ambient air as its fluid pumping medium (although it is within the concepts of this invention to utilize pumping fluids other than air, e.g., oil), and to this end, a line 38 may extend from the inlet 32 to a position above the surface 12 so as to place the inlet 32 in open communication with an ambient air controlled, of course, by the check valve 34. A filter 40 may be added to the intake end of the line 38 if desired.

At its opposite end the tube 18 is provided with an outlet 42 which, in turn, is controlled by a check valve 44. The check valve 44, in contradistinction to the check valve 34, is operable to permit fluid flow out of the outlet 42 during a pumping stroke of the tube 18 but serves to close the outlet 42 against retrograde movement of fluid back into the tube 18 through the outlet 42. In the arrangement illustrated in FIG. 2, a short line 46 as been shown between the outlet 42 and the check valve 44, but it will be well understood by those skilled in the art that the check valve 44 may be directly adjacent the outlet 42 if desired, in which case the line 46 would not be utilized.

If desired, the line 46 downstream from the check valve 44 may be connected directly to fluid-operated means of chosen design for the purpose of receiving the operating slugs of fluid pressure supplied by the tube 18 each time the latter is actuated. In the alternative, and perhaps in the prefered form, the line 46 may be connected with a holding tank 48 upstream from the equipment which is to utilize the fluid pressure developed by the pump 18.

Figure 1:
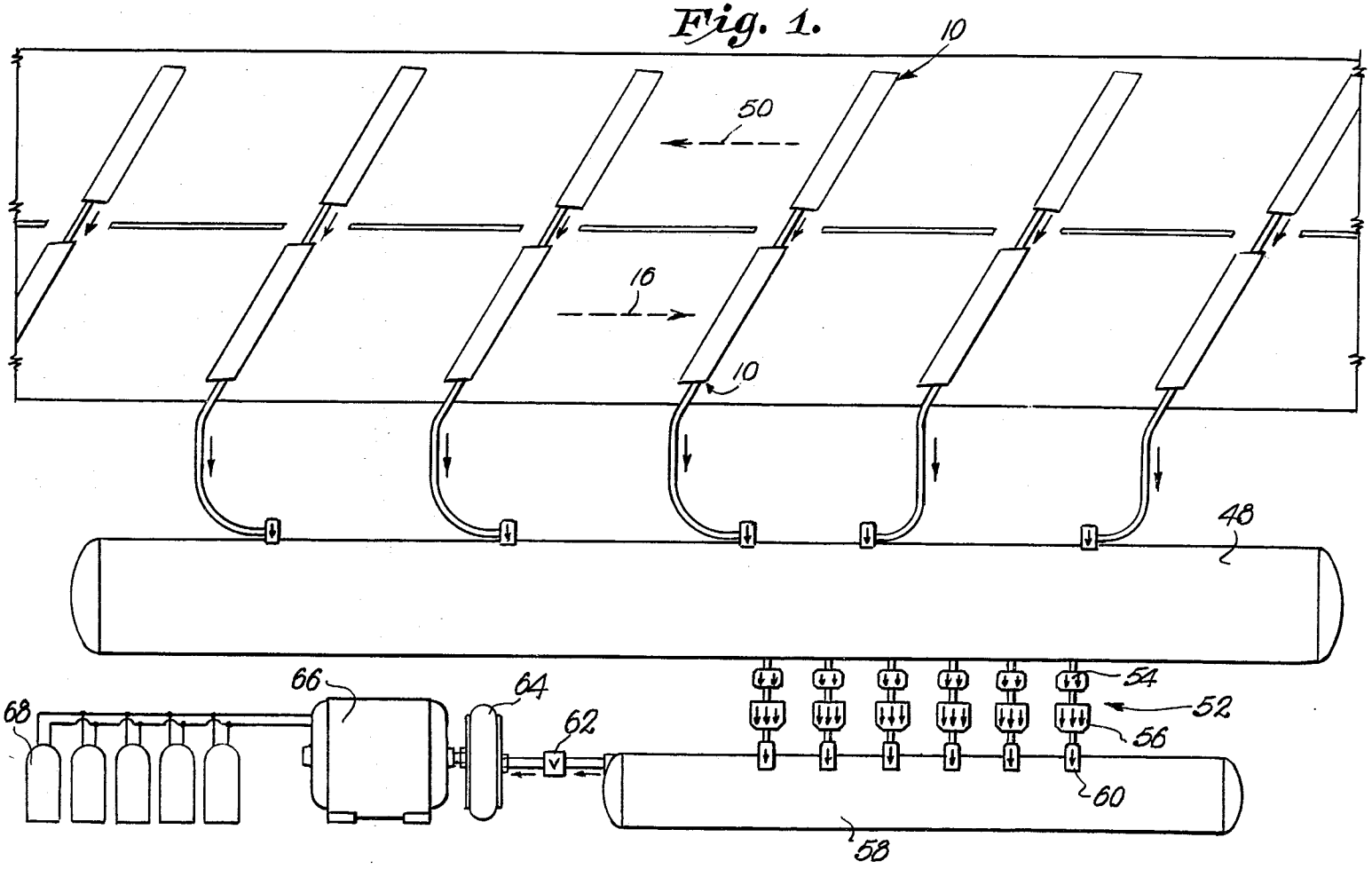
FIG. 1 is a schematic illustration of an energy conservation system constructed in accordance with the principles of the present invention.

In this connection, FIG. 2 shows a second pump tube installation 10 along the surface 12 and FIG. 1 shows a series of such pump tubes 10 in two different lanes of traffic, it being contemplated that a multitude of the pumps 10 may be connected to a common holding tank 48 so as to provide a larger supply of pressurized fluid from which operating power can be drawn. In this manner, although each of the tubes 18 may be intermittently operated, in view of the fact that they all supply fluid to the common tank 48, a steady source of constant operating pressure may be obtained from the tank 48.

It is noted that FIG. 1 shows tubes 18 disposed to receive operation by traffic in two opposite directions, i.e., that indicated by the arrow 16 and that indicated by the arrow 50. It is, of course, contemplated that the treadles 28 of the traffic flow in the direction of arrow 50 will be inclined oppositely of the treadles 28 associated with traffic flow in the direction 16. Moreover, although FIG. 1 shows pairs of the pumps 10 connected in a series relationship to one another, it is likely that, in practice, all of the pumps 10 would be connected in a "parallel" arrangement so that, instead of feeding from one pump 10 into another pump 10, all of the pumps 10 would lead directly into the tank 48.

Although it is contemplated that the pressurized fluid within the holding tank 48 may be quite adequate for driving many types of equipment, nonetheless it is recognized that in certain circumstances this pressure may need to be boosted. In this connection, apparatus broadly denoted by the numeral 52 may be connected in fluid pressure receiving relationship with the tank 48. Such apparatus 52 may, for example, include rotary fluid motors 54 which are in turn connected in such a way with downstream rectilinear ram assemblies 56 as to boost the pressure of the fluid flowing into another tank 58 controlled by check valves 60. The discharge from the tank 58 is in turn communicated with a reduction valve 62 whose fluid output in turn may drive, for example, a turbine 64 operably connected to a generator 66. Transformers 68 and electrically powered equipment associated therewith may be connected to the generator 66.

It should be apparent from the foregoing description that the resilient nature of the pumping tube 18 allows the wall thereof to be collapsed during each positive pressure pumping stroke and to return under its own action to its normal condition of FIG. 3. During return to the normal uncollapsed condition of FIG. 3, the tube 18 moves through a suction stroke as the volume of its internal chamber 36 is restored and expanded to its normal condition after being compressed. The treadle 28, of course, transmits operating impulses from traffic along the surface 12 to the bearing member 22 which in turn compresses the tube 18. As soon as the impulse from the traffic is relieved, the tube 18 returns to its normal position.

The check valves 34 and 44 are of course important components associated with each of the pumps 10 inasmuch as the check valve 34 permits the intake of a new supply of fluid into the chamber 36 as the tube 18 expands during its suction stroke, while the check valve 44 permits discharge of the positive slug of pressurized fluid from the tube 18 during its positive pressure pumping stroke. Although not entirely clear from the figures, the opposite ends of each tube 18 are of course entirely closed, except for the pressence of the inlet 32 and the outlet 42.

It should thus be readily apparent that the present invention provides a unique way of using energy heretofore entirely wasted. Movement of traffic of all kinds along established surfaces, whether foot traffic, vehicular traffic or that of moving mechanisms, can be put to beneficial use so as to preserve our precious energy resources.

An alternative embodiment to the tube pump 18 is illustrated briefly in FIG. 4 in which the pump denoted broadly by the numeral 110 is in the form of a piston and cylinder assembly 118. The principle of operation of the piston and cylinder assembly 118 is exactly the same as with the tube pump 18, it being noted that the resilience necessary to return the piston of the assembly 118 to its extended condition is provided by a coil spring 119 corresponding to the resilient wall of the tube pump 18. The number of each of the assemblies 118 provided within each recess 114 depends upon a number of factors which need not be elaborated upon herein.

It should be apparent that the foregoing detailed description relates to only certain of the several ways in which the principles of the present invention can be carried out. Accordingly, it is to be understood that the foregoing description is exemplary only, it being apparent that minor changes can be made by those skilled in the art without departing from the principles of the present invention. Our scope of patent protection should therefore be limited only by the fair scope of the claims which follow.

We claim:

1. For use in association with a surface along which recurrent traffic moves, an energy conservation system comprising:

A fluid pump operable through a pumping stroke to emit a slug of fluid through an outlet of the pump, said pump further being operable through a suction stroke to intake a new supply of fluid through an inlet of the pump;

a first check valve operably associated with said inlet of the pump for permitting fluid flow into the pump through said inlet during said suction stroke and for precluding fluid flow out of the pump through said inlet during said pumping stroke;

a second check valve operably associated with said outlet of the pump for permitting fluid flow out of the pump through said outlet during said pumping stroke and for precluding retrograde fluid flow into the pump through said outlet during said suction stroke;

means for disposing said pump in force-transmitting relationship to said surface;

a traffic-operated actuator disposed in force-transmitting relationship with said pump in opposition to said surface for receiving operating impulses from said traffic; and fluid-operated means coupled in flow communication with said outlet of the pump beyond said second check valve for receiving slugs of pressurized fluid from the pump and for performing a work function, said pump including a resilient device having a variable volume pumping chamber associated therewith, said device flexing to a position of minimum chamber volume during said pumping stroke and returning to a position of maximum chamber volume during said suction stroke, said device comprising a resiliently walled tube disposed transversely of the path of travel of said traffic, said tube being provided with a bearing member between the tube and said actuator for preventing direct physical contact between said actuator and the tube, said surface including a recess receiving said tube, said recess having a liner therein between the surface and the tube, said bearing member being hingedly secured to said liner for flexure with the tube during said pumping and suction strokes thereof.

2. An energy conservation system as claimed in claim 1, wherein said inlet of the pump is exposed to ambient air, said fluid comprising said ambient air.

3. An energy conservation system as claimed in claim 1, wherein said actuator includes a hinged panel overlying said recess and swingable toward and away from the same during operation thereof by said traffic.

4. An energy conservation system as claimed in claim 3, wherein a portion of said pump projects outwardly beyond said recess into the path of travel of said traffic, said portion of the pump supporting said panel in an outwardly inclined position with respect to said recess prior to operation of the panel by said traffic.

5. An energy conservation system as claimed in claim 4, wherein said pump includes means yieldably biasing said panel toward said position.

6. An energy conservation system as claimed in claim 1, wherein said check valves are located at opposite ends of said tube.

7. An energy conservation system as claimed in claim 1, wherein said fluid-operated means includes a turbine and a generator operably connected with said turbine for generating electrical energy.

8. An energy conservation system as claimed in claim 1; and booster apparatus connected between said fluid-operated means and said pump for increasing the fluid pressure available for operating said fluid-operated means.

9. An energy conservation system as claimed in claim 1, wherein said system includes a series of said pumps, check valves and actuators, said system further including a storage tank common to said pumps for receiving and accumulating said slugs of fluid therefrom, said tank being located between the said second check valves and said fluid-operated means.

* * * * *